US008684712B2

(12) United States Patent
Honda et al.

(10) Patent No.: US 8,684,712 B2
(45) Date of Patent: Apr. 1, 2014

(54) OIL PUMP FOR A VEHICLE

(75) Inventors: Hiroyasu Honda, Toyota (JP); Hideki Miyata, Okazaki (JP); Nobuyuki Kato, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 996 days.

(21) Appl. No.: 12/776,456

(22) Filed: May 10, 2010

(65) Prior Publication Data

US 2010/0290941 A1 Nov. 18, 2010

(30) Foreign Application Priority Data

May 12, 2009 (JP) ..... 2009-115999
Sep. 3, 2009 (JP) ..... 2009-204069

(51) Int. Cl.
*F01C 1/02* (2006.01)
*F03C 2/00* (2006.01)

(52) U.S. Cl.
USPC ..... 418/61.3

(58) Field of Classification Search
USPC ..... 418/61.3
See application file for complete search history.

(56) References Cited

U.S. PATENT DOCUMENTS

| | | | | |
|---|---|---|---|---|
| 3,139,835 | A * | 7/1964 | Wilkinson | 418/9 |
| 3,443,378 | A * | 5/1969 | Goff et al. | 60/384 |
| 4,813,856 | A * | 3/1989 | Dlugokecki | 418/61.3 |
| 2005/0063851 | A1 * | 3/2005 | Phillips | 418/61.3 |
| 2005/0214149 | A1 * | 9/2005 | Harle et al. | 418/61.3 |
| 2005/0254982 | A1 * | 11/2005 | Cadeddu | 418/61.3 |

FOREIGN PATENT DOCUMENTS

| | | | |
|---|---|---|---|
| JP | 61-171885 | A | 8/1986 |
| JP | 61-171885 | U | 10/1986 |
| JP | 08-232855 | A | 9/1996 |

OTHER PUBLICATIONS

Chinese Office Action for corresponding CN Patent Application No. 201010176305.X issued on Jul. 2, 2012.

* cited by examiner

*Primary Examiner* — Hoang Nguyen
(74) *Attorney, Agent, or Firm* — Sughrue Mion, PLLC

(57) ABSTRACT

A plurality of convex portions that protrude radially outward from a plurality of positions separated in the circumferential direction are provided on the outer peripheral surface of a driven gear. Each convex portion has, in the circumferential direction of the driven gear, a rising surface that rises from a minimum diameter position to a maximum diameter position in the direction opposite the rotational direction of the driven gear, and a falling surface that falls from that maximum diameter position to a minimum diameter position that is adjacent to and in back of that maximum diameter position with respect to the rotational direction of the driven gear. The circumferential length of the falling surface is greater than the circumferential length of the rising surface.

12 Claims, 9 Drawing Sheets

OIL PUMP FOR A VEHICLE

INCORPORATION BY REFERENCE

The disclosure of Japanese Patent Applications No. 2009-115999 and No. 2009-204069 filed on May 12, 2009 and Sep. 3, 2009, respectively, including the specification, drawings and abstract is incorporated herein by reference in its entirety.

BACKGROUND OF THE INVENTION

1. Field of the Invention

The invention relates to an internal gear oil pump for a vehicle, and more particularly, technology for reducing rotational resistance of that internal gear oil pump for a vehicle.

2. Description of the Related Art

One known internal gear oil pump for a vehicle is provided with a pump body having a pump chamber formed by a cylindrical inner peripheral surface, an annular driven gear that has internal teeth and is rotatably supported by the cylindrical inner peripheral surface by fitting with the cylindrical inner peripheral surface, and a drive gear that has external teeth that mesh with the internal teeth of the driven gear, is rotationally provided about a rotational center that is offset from the rotational center of the driven gear, and rotatably drives the driven gear. In this kind of internal gear oil pump for a vehicle, when the driven gear is not rotating, its own weight causes it to contact the pump body. However, when the driven gear is being rotatably driven, hydraulic fluid in the annular gap between the driven gear and the pump body is dragged by the rotation of the driven gear, and consequently, moves in the circumferential direction in the gap. As the hydraulic fluid flows into the gradually narrowing gap toward the location where the driven gear and the pump body are close together, maximum dynamic pressure is generated at that location, such that the driven gear is supported without contacting the pump body. Incidentally, this dynamic pressure is pressure that acts to push the outer peripheral surface of the driven gear toward the inner peripheral side.

One problem with this internal gear oil pump for a vehicle is that the driven gear wobbles, that is, the rotational center of the driven gear wobbles, at low rotation speeds and when a large amount of hydraulic pressure is generated, for example. This wobbling of the rotational center of the driven gear may cause the lubrication state between the outer peripheral surface of the driven gear and the cylindrical inner peripheral surface of the pump body to become a boundary lubrication state, such that friction loss occurs which may increase the rotational resistance of the driven gear. To solve this, Japanese Utility Model Application Publication No. 61-171885 (JP-U-61-171885) proposes technology for suppressing wobbling of the rotational center of the driven gear. In JP-U-61-171885, a plurality of concave portions, each having a stepped cross-section orthogonal to the rotational axis of the driven gear, are provided at predetermined intervals in the circumferential direction on the outer peripheral surface of the driven gear. When the driven gear is rotatably driven, far more dynamic pressure than is generated with a structure that lacks the concave portions is generated in the hydraulic fluid in the part of a gap, which is formed between the outer peripheral surface of the driven gear and the pump body, where the concave portions are located. Compared with a structure that lacks the concave portions, the self-aligning ability of the driven gear in the internal gear oil pump for a vehicle described in JP-U-61-171885 is improved due to the far greater dynamic pressure acting on the driven gear, which enables the wobbling of the rotational center of the driven gear to be suppressed.

Incidentally, in the internal gear oil pump described above, the problem of the rotational center of the driven gear wobbling when the driven gear rotates is solved, thus making it possible to maintain a good lubrication state between the driven gear and the pump body, by generating a relatively large amount of dynamic pressure by forming the plurality of concave portions on the outer peripheral surface of the driven gear as described above. As a result, friction loss due to the driven gear and the pump body contacting or being in close proximity to one another is able to be suppressed, so in this respect, rotational friction of the driven gear is considered to be reduced. However, forming the plurality of concave portions results in a pressure drop at the part of the gap between the driven gear and the pump body where the height of the gap increases in the direction opposite the rotational direction of the driven gear, due to peeling at the flow lines of the hydraulic fluid that flows by that part. Therefore, the pressure difference in the circumferential direction of the gap between the driven gear and the pump body increases, causing force that impedes the rotation of the driven gear, i.e., pressure drag (pressure resistance), to act on the driven gear. As a result, a new problem arises in which the rotational resistance of the driven gear increases.

SUMMARY OF THE INVENTION

This invention provides an internal gear oil pump for a vehicle, in which the rotational resistance is reduced by reducing the pressure drag (pressure resistance) acting on the driven gear.

A first aspect of the invention relates to an internal gear oil pump for a vehicle. This internal gear oil pump includes a pump body that has a pump chamber formed by a cylindrical inner peripheral surface; a driven gear that has an annular shape, that has internal teeth, and is rotatably supported by the cylindrical inner peripheral surface by fitting with the cylindrical inner peripheral surface; and a drive gear that has external teeth that mesh with the internal teeth of the driven gear, is rotatably provided about a rotational center that is offset from the rotational center of the driven gear, and rotatably drives the driven gear. A plurality of convex portions that protrude radially outward from a plurality of positions separated in the circumferential direction are formed on the outer peripheral surface of the driven gear. Each convex portion has, in the circumferential direction of the driven gear, a rising surface that rises from a minimum diameter position to a maximum diameter position in the direction opposite the rotational direction of the driven gear, and a falling surface that falls from the maximum diameter position to the minimum diameter position that is adjacent to and in back of the maximum diameter position with respect to the rotational direction of the driven gear. Also, the circumferential length of the falling surface is greater than the circumferential length of the rising surface.

With this internal gear oil pump for a vehicle, the plurality of convex portions that protrude radially outward from a plurality of positions separated in the circumferential direction are provided on the outer peripheral surface of the driven gear. Each convex portion has the rising surface and the falling surface in the circumferential direction of the driven gear. The rising surface rises from the minimum diameter position to the maximum diameter portion in the direction opposite the rotational direction of the driven gear. The falling surface falls from the maximum diameter position to the minimum diameter position that is adjacent to and in back of that maximum diameter position with respect to the rotational direction of the driven gear. The circumferential length of the falling surface is greater than the circumferential length of the rising surface. That is, the rising surface is formed such that the thickness in the radial direction of the driven gear strictly increases from the minimum diameter position that is in front of the maximum diameter position with respect to the rotational direction of the driven gear, to the maximum diameter position, and the falling surface is formed such that the thickness in the radial direction of the driven gear strictly decreases from the maximum diameter position to the minimum diameter position that is in back of the maximum diameter position with respect to the rotational direction of the driven gear. Accordingly, a relatively large amount of dynamic pressure is generated in the hydraulic fluid that flows between the rising surface of the convex portion and the pump body, so the self-aligning ability of the driven gear is improved. In addition, the height of the gap formed between the falling surface of the convex portion and the pump body gradually increases in the direction opposite the rotational direction of the driven gear, which inhibits the hydraulic fluid that flows through that gap from peeling. As a result, an increase in the pressure difference in the circumferential direction in the hydraulic fluid that flows between the driven gear and the pump body due to that peeling is inhibited, which in turn inhibits the pressure drag (i.e., pressure resistance) that acts on the driven gear in a manner that impedes the rotation of the driven gear from increasing. Thus, the rotational resistance of the driven gear can be reduced. Also, because the rotational resistance of the driven gear is reduced, the rotational resistance (i.e., the axial torque resistance) of the drive gear can also be reduced.

Here, in this specification, the term streamlined shape refers to the shape of an object around which the flow of fluid is smooth such that a vortex does not develop in that flow. In other words, the term streamlined shape refers to the shape of an object, which when that object is placed in an appropriate posture in the flow of a given fluid, does not cause the boundary layer of the fluid that develops at the surface of the object to peel, such that a vortex does not develop. Also, the term peel refers to a phenomenon in which the fluid particles separate from the surface of an object placed in the flow of a given fluid. However, when peeling does not occur, it means that the fluid particles do not separate from the surface of an object placed in the flow of a given fluid.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Firth through fifth example embodiments of the invention will be described in greater detail below with reference to the accompanying drawings. Incidentally, the drawings described in the example embodiment below have been simplified or modified as appropriate, so the scale ratios and the shapes and the like of the portions are not always accurately depicted.

Figure 1:
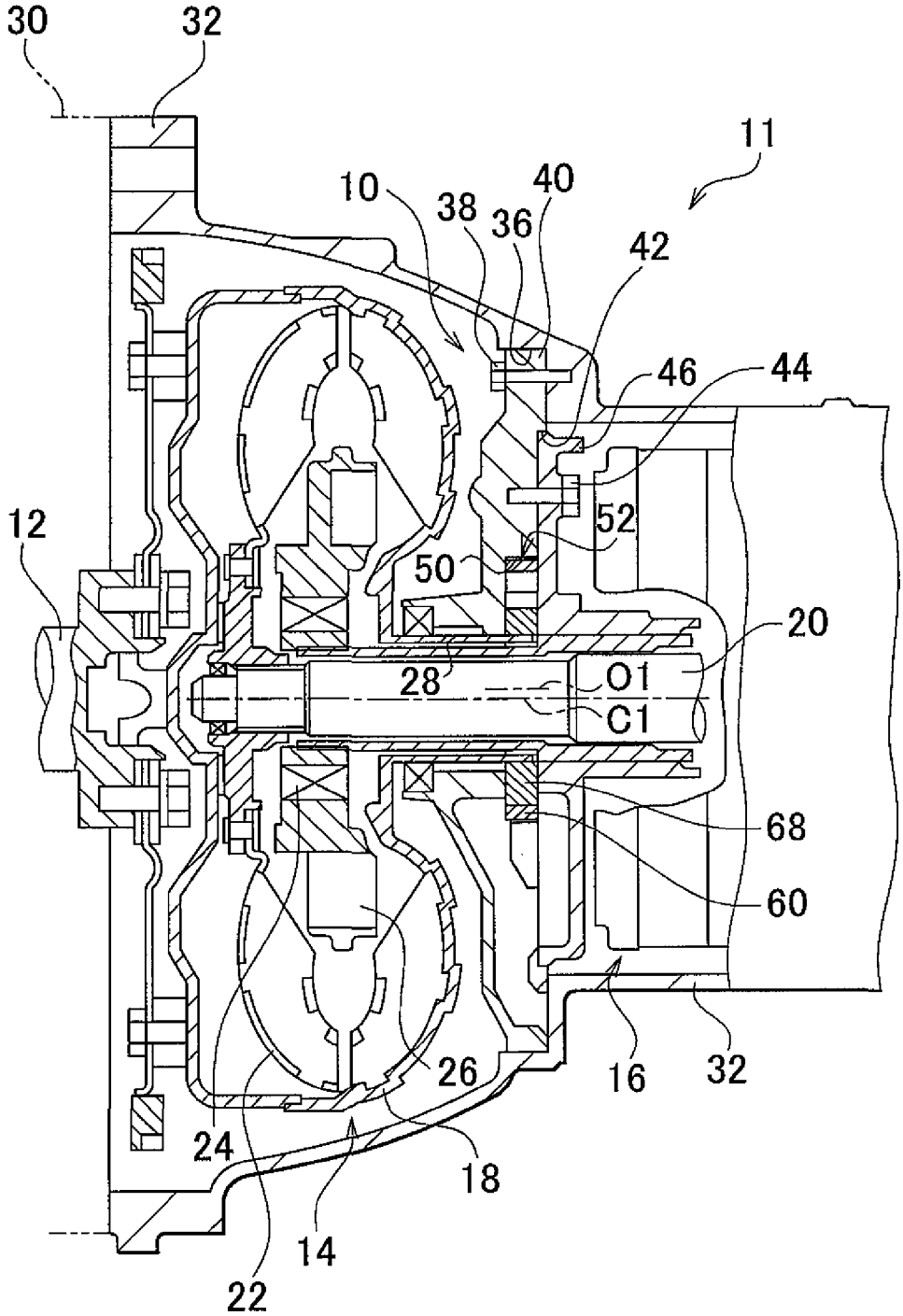
FIG. 1 is a partial sectional view of a portion of a vehicular power transmitting apparatus that includes an internal gear oil pump for a vehicle according to first through fifth example embodiments of the invention.

FIG. 1 is a partial sectional view of part of a vehicular power transmitting apparatus 11 that includes an internal gear oil pump for a vehicle (hereinafter referred to simply as "oil pump") 10 according to one example embodiment of the invention. This vehicular power transmitting apparatus 11 includes an automatic transmission 16 and a torque converter 14 provided after (i.e., downstream with respect to the flow of power from the engine) a crankshaft (i.e., an output member) 12 of an engine that serves as the driving source of the vehicle. Incidentally, in FIG. 1, only a portion of the automatic transmission 16 is shown.

As shown in FIG. 1, the torque converter 14 includes a pump impeller 18, a turbine runner 22, and a stator 26. The pump impeller 18 is connected to the crankshaft 12 of the engine such that power can be transmitted therebetween. The turbine runner 22 is provided so as to be able to rotate relative to the pump impeller 18, and is connected to an input shaft 20 of the automatic transmission 16 such that power can be transmitted therebetween. The stator 26 is arranged between the pump impeller 18 and the turbine runner 22, and is rotatably supported via a one-way clutch 24. The input shaft 20 also functions as a turbine shaft that serves as an output member of the torque converter 14. With the torque converter 14 structured in this way, the rotation of the pump impeller 18 that rotates together with the crankshaft 12 is transmitted to the turbine runner 22 via hydraulic fluid that is circulated by the pump impeller 18. Here, a cylindrical sleeve 28 that protrudes to the side opposite the automatic transmission 16 side, i.e., opposite the turbine runner 22 side, is provided on the inner peripheral portion of the pump impeller 18 on the outer peripheral side of the input shaft 20. The oil pump 10 is rotatably driven by this sleeve 28.

The automatic transmission 16 is a well-known stepped automatic transmission that includes a plurality of planetary gear sets, and plurality of hydraulic friction engagement devices for selectively engaging the constituent elements of these planetary gear sets to each other or to a non-rotating member, and selectively establishes a plurality of speeds by selectively engaging the plurality of hydraulic friction engagement devices according to a shift command from a shift electronic control unit. In the automatic transmission 16 structured in this way, the rotation of the input shaft 20 that rotates together with the turbine runner 22 is changed according to the speed and then output. Incidentally, a propeller shaft, a differential gear unit, and an axle, and the like, for example, none of which are shown, are provided after (i.e., downstream of) the automatic transmission 16. The rotation output from the automatic transmission 16 is transmitted to driving wheels via the propeller shaft, the differential gear unit, and the axle.

The torque converter 14 and the automatic transmission 16 are housed inside a cylindrical transmission case 32 that is fixed to an engine block 30 shown by the alternate long and two short dashes line in FIG. 1. The input shaft 20 is provided extending through a partition wall provided between a chamber that houses the torque converter 14 and a chamber that houses the automatic transmission 16 inside the transmission case 32. The oil pump 10 is provided in this partition wall. The oil pump 10 includes a pump body 40 and a pump cover 46. The pump body 40 is formed in an annular shape on the outer peripheral side of the sleeve 28 and is fixed to the transmission case 32 by a bolt 38 while fitted into a stepped hole 36 formed in the inner peripheral surface of the transmission case 32. The pump cover 46 is formed in an annular shape on the outer peripheral side of the input shaft 20 and is fixed to the pump body 40 by a bolt 44 while fitted into a shallow, relatively large diameter fitting hole 42 formed in the end surface of the pump body 40, on the opposite side of the pump body 40 from the torque converter 14. A cylindrical inner peripheral surface 50 that has a smaller diameter than the fitting hole 42 and a short cylindrical surface shape with an axis O1 that is offset from a central rotational axis C1 of the sleeve 28 and the input shaft 20, is formed in the bottom surface of the fitting hole 42 of the pump body 40. The pump body 40 has a pump chamber 52 formed by the cylindrical inner peripheral surface 50. This pump chamber 52 is formed by an annular space that is offset with respect to the central rotational axis C1 of the sleeve 28 on the outer peripheral side of the sleeve 28.

Figure 2:
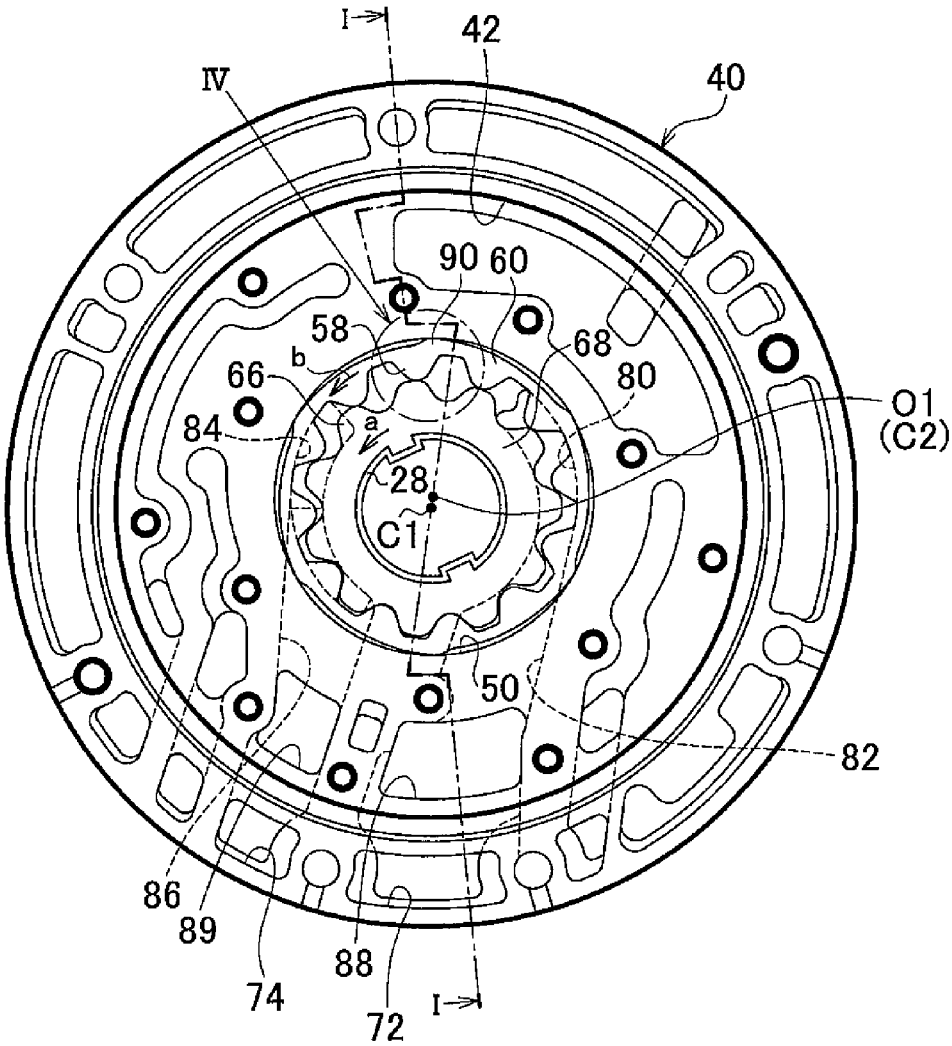
FIG. 2 is a view of a driven gear and a drive gear assembled to a pump body, as shown from the side of the pump body that is mounted to a transmission case shown in FIG. 1.

FIG. 2 is a view of the oil pump 10 as viewed from the side of the pump body 40 that is mounted to the transmission case 32 shown in FIG. 1. Incidentally, the surface of the oil pump 10 shown in FIG. 1 is the sectional surface along line I-I in FIG. 2. As shown in FIGS. 1 and 2, the oil pump 10 has the pump body 40 that has the pump chamber 52 formed by the cylindrical inner peripheral surface 50, the pump cover 46 that covers the opening on one end side of the pump chamber 52, an annular driven gear 60 that has internal teeth 58 and is rotatably supported by the cylindrical inner peripheral surface 50 by fitting with the cylindrical inner peripheral surface 50, and a drive gear 68 that has external teeth 66 that mesh with the internal teeth 58 of the driven gear 60, is fitted onto the outer peripheral surface of the sleeve 28 so that it can rotate about the central rotational axis C1 that is offset from the central rotational axis C2 of the driven gear 60, and rotatably drives the driven gear 60. The drive gear 68 is rotatably driven in the rotational direction indicated by arrow "a" in FIG. 2 about the central rotational axis C1 by the sleeve 28. The driven gear 60 is rotatably driven in the rotational direction indicated by arrow "b" in FIG. 2 about the central rotational axis C2 by the drive gear 68. The oil pump 10 in the first example embodiment of the invention is an internal gear pump in which the external teeth 66 and the internal teeth 58 of the driven gear 60, of which there is one more than the number of external teeth 66, mesh together in the lower portion of the pump chamber 52. The volume of a plurality of spaces formed divided by the internal teeth 58 of the driven gear 60 and the external teeth 66 of the drive gear 68 in the pump chamber 52 increases as the driven gear 60 moves from down to up in the pump chamber 52, and decreases as the driven gear 60 moves from up to down in the pump chamber 52, while rotating about the central rotational axis C2 by the drive gear 68 and the driven gear 60 rotating.

An intake side connecting port 72 and a delivery side connecting port 74 are formed in the outer peripheral portion of the surface of the pump body 40 that is mounted to the transmission case 32. The intake side connecting port 72 is connected to an intake oil passage, not shown, for receiving hydraulic fluid that circulates to an oil pan and the like of the automatic transmission 16, for example. The delivery side connecting port 74 is connected to a line oil passage, not shown, for delivering hydraulic fluid to a hydraulic control circuit that controls the hydraulic friction engagement devices and the like, for example. Also, a first oil introducing passage 82 and a first oil delivery (i.e., discharge) passage 86 are formed in the pump body 40. The first oil introducing passage 82 communicates the intake side connecting port 72 with a first intake port 80 that opens to the pump body 40 side of the pump chamber 52. The first oil delivery (i.e., discharge) passage 86 communicates the delivery side connecting port 74 with a first discharge port 84 that opens to the pump body 40 side of the pump chamber 52. Then, a second oil introducing passage, not shown, and a second oil delivery (i.e., discharge) passage, also not shown, are formed in the pump cover 46. The second oil introducing passage communicates the intake side connecting port 72 with a second intake port, not shown, that opens to the pump cover 46 side of the pump chamber 52. The second oil delivery (i.e., discharge) passage communicates the delivery side connecting port 74 with a second discharge port, not shown, that opens to the pump cover 46 side of the pump chamber 52. The second oil introducing passage is communicated with the first oil introducing passage 82 by a first communicating port 88 formed in the bottom surface of the fitting hole 42 of the pump body 40. Also, the second oil delivery passage is communicated with the first oil delivery passage 86 by a second communicating port 89 formed in the bottom surface of the fitting hole 42 of the pump body 40. Incidentally, the first intake port 80 and the second intake port are formed in positions in the circumferential direction on the outer peripheral side of the drive gear 68 in the pump chamber 52, where the volume of the plurality of spaces formed divided by the internal teeth 58 of the driven gear 60 and the external teeth 66 of the drive gear 68 increases by the rotation of the drive gear 68 and the driven gear 60. On the other hand, the first discharge port 84 and the second discharge port are formed in positions in the circumferential direction on the outer peripheral side of the drive gear 68 in the pump chamber 52, where the volume of the plurality of spaces formed divided by the internal teeth 58 of the driven gear 60 and the external teeth 66 of the drive gear 68 decreases by the rotation of the drive gear 68 and the driven gear 60.

With the oil pump 10 structured in this way, the hydraulic fluid from the oil pan is drawn up from the first intake port 80 or the second intake port and into the pump chamber 52 via the intake side connecting port 72 and either the first oil introducing passage 82 or the second oil introducing passage as the drive gear 68 is rotated in the rotational direction indicated by arrow "a" in FIG. 2 by the sleeve 28, and the driven gear 60 is rotated in the rotational direction indicated by arrow "b" in FIG. 2 by the drive gear 68. Then, the hydraulic fluid that has been introduced into the plurality of spaces formed divided by the internal teeth 58 of the driven gear 60 and the external teeth 66 of the drive gear 68 in the pump chamber 52 is carried from the circumferential position where the volume of those spaces increases to the circumferential position where the volume of those spaces decreases as the drive gear 68 rotates, and then discharged from the delivery side connecting port 74 into the hydraulic control circuit via either the first discharge port 84 or the second discharge port, and either the first oil delivery passage 86 or the second delivery port.

Figure 3:
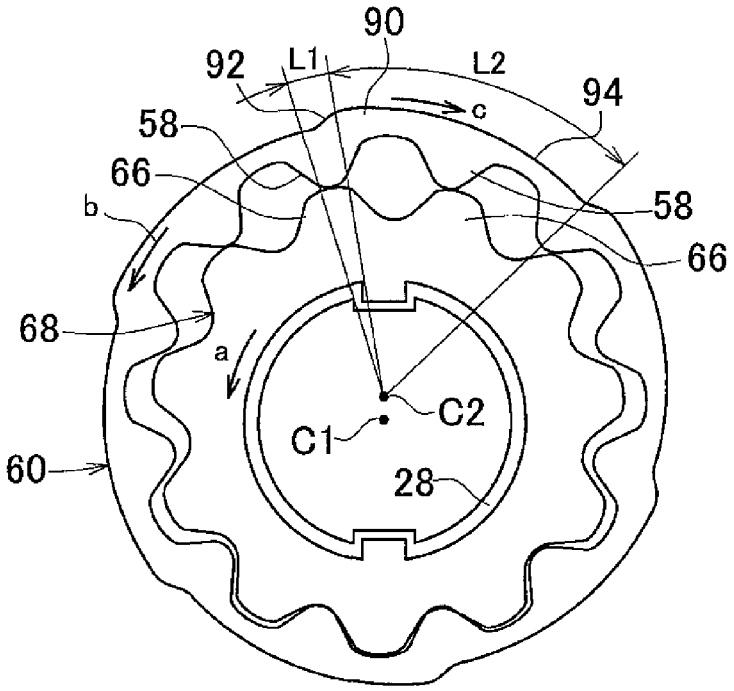
FIG. 3 is an enlarged view of the drive gear and the driven gear shown in FIG. 2.
Figure 4:
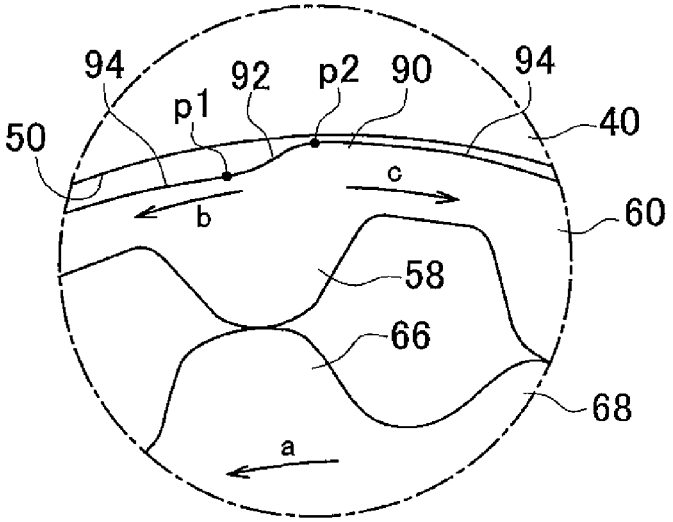
FIG. 4 is an enlarged view of the portion encircled by line IV in FIG. 2.

FIG. 3 is an enlarged view of the drive gear 68 and the driven gear 60 shown in FIG. 2. Also, FIG. 4 is an enlarged view of the portion encircled by line IV in FIG. 2. As shown in FIGS. 2 to 4, a plurality (six in this example embodiment) of convex portions 90 that protrude radially outward from a plurality of positions equal distances apart in the circumferential direction are provided on the outer peripheral surface of the driven gear 60. Each of the convex portions 90 has a rising surface 92 and a falling surface 94 in the circumferential direction of the driven gear 60. The rising surface 92 rises from a smallest diameter position p1 to a largest diameter position p2, as shown in FIG. 4, in the direction opposite the rotational direction of the driven gear 60, i.e., in the direction of arrow "c" which is opposite the rotational direction indicated by arrow "b". The falling surface 94 falls from the maximum diameter position p2 to the minimum diameter position p1 that is adjacent to that maximum diameter position p2 in the direction of arrow "c". As shown in FIG. 3, the circumferential length L2 of the falling surface 94 is greater than the circumferential length L1 of the rising surface 92. In this example embodiment, the circumferential length L2 is approximately seven times the circumferential length L1.

The falling surface 94 is formed such that the shape of its cross section that is orthogonal to the central rotational axis C2 of the driven gear 60 is streamlined in the circumferential direction of the driven gear 60. The rising surface 92 is formed rising from the minimum diameter position p1 that coincides with the terminal end position of the streamlined shape of the falling surface 94 that is adjacent to and in front of that rising surface 92 with respect to the rotational direction of the driven gear 60 (i.e., in the direction of arrow "b"). More specifically, as shown in FIG. 4, the rising surface 92 is formed such that the radial distance from the central rotational axis C2 continuously increases from the minimum diameter position p1 that coincides with the terminal end position of the streamlined shape of the falling surface 94 that is adjacent in the direction of arrow "b" to the rising surface 92, to the maximum diameter position p2 that coincides with the starting end position of the streamlined shape of the falling surface 94 that is adjacent to the rising surface 92 in the direction of arrow "c". On the other hand, the falling surface 94 is formed such that the radial distance from the central rotational axis C2 continuously decreases from the maximum diameter position p2 that coincides with the terminal end position of the rising surface 92 that is adjacent in the direction of arrow "b" to the falling surface 94, to the minimum diameter position p1 of the starting end position of the rising surface 92 that is adjacent in the direction of arrow "c" to the falling surface 94. The rising surface 92 and the falling surface 94 are formed continuous and alternate in the circumferential direction on the outer peripheral surface of the driven gear 60. Therefore, no portion of the outer peripheral surface of the driven gear 60 is a partially cylindrical surface in which the radial distance from the central rotational axis C2, when the central rotational axis C2 is the center of curvature, is constant in the circumferential direction. In this example embodiment, forming the rising surface 92 on the outer peripheral surface of the driven gear 60 makes the height of the gap formed between the rising surface 92 and the cylindrical inner peripheral surface 50 of the pump body 40 decrease suddenly and in a continuous manner in the direction opposite the rotational direction of the driven gear 60. Also, forming the falling surface 94 on the outer peripheral surface of the driven gear 60 makes the height of the gap formed between the falling surface 94 and the cylindrical inner peripheral surface 50 of the pump body 40 increase gradually and in a continuous manner in the direction opposite the rotational direction of the driven gear 60. Each convex portion 90 is formed in a wedge shape in which the radial distance gradually decreases in the direction opposite the rotational direction of the driven gear 60.

With the oil pump 10 provided with this kind of driven gear 60, when the driven gear 60 is rotated, the hydraulic fluid in the annular gap formed between the driven gear 60 and the pump body 40 is dragged by the rotation of the driven gear 60, and consequently, moves in the circumferential direction in the gap. Hydraulic fluid flowing into the portion of the annular gap on the outer peripheral side of the falling surface 94 of the driven gear 60 where the height of the gap between the driven gear 60 and the pump body 40 decreases causes maximum dynamic pressure P to be generated at the area directly in front of that portion where the height decreases. This dynamic pressure P acts on the driven gear 60, pushing the outer peripheral surface of the driven gear 60 toward the inner peripheral side. Therefore, the driven gear 60 is supported in a non-contact manner by the pump body 40 when the driven gear 60 rotates. Then, when hydraulic fluid flows along the outer peripheral side of the falling surface 94 where the height of the annular gap between the driven gear 60 and the pump body 40 increases in the direction opposite the rotational direction of the driven gear 60, the flow of hydraulic fluid is inhibited from peeling because the height of the gap gradually increases in the direction opposite the rotational direction of the driven gear 60 due to the circumferential length L2 of the falling surface 94 being greater than the circumferential length L1 of the rising surface 92. Therefore, an increase in the pressure difference in the circumferential direction of the gap due to that peeling, and thus, an increase in the pressure drag (i.e., pressure resistance) that acts on the driven gear, impeding its rotation, can be suppressed. With the oil pump 10 in this example embodiment, a plurality of the convex portions 90, each of which has the rising surface and the falling surface described above, are provided in the circumferential direction on the outer peripheral surface of the driven gear 60. Compared with a mode in which the convex portions 90 are not provided, the dynamic pressure P is far greater, and peeling in the flow of the hydraulic fluid is suppressed more because the flow of hydraulic fluid in the gap between the driven gear 60 and the pump body 40 is smoother. These points will now be described in greater detail.

Figure 5:
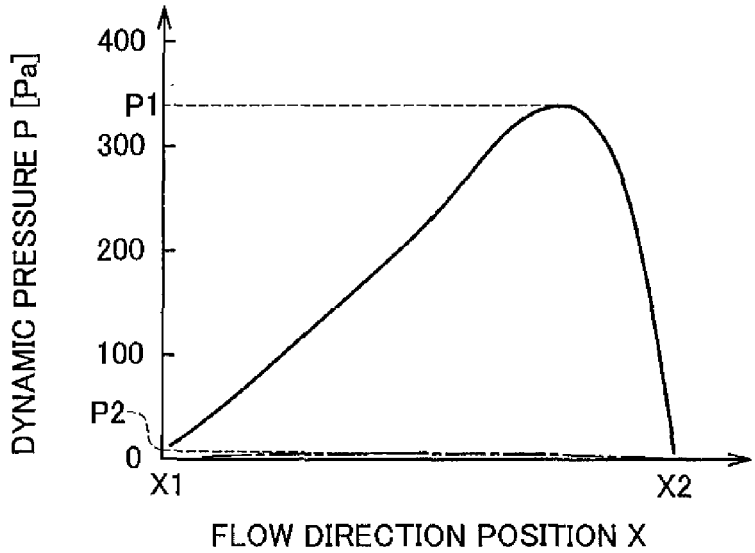
FIG. 5 is a view showing a comparison between the dynamic pressure generated in the hydraulic fluid when hydraulic fluid flows through a narrowing flow path formed such that the flow path height continuously decreases as shown in frame format in FIG. 6, and the dynamic pressure generated in the hydraulic fluid when hydraulic fluid flows through a parallel flow path formed such that the flow path height is uniform as shown in frame format in FIG. 7.
Figure 6:
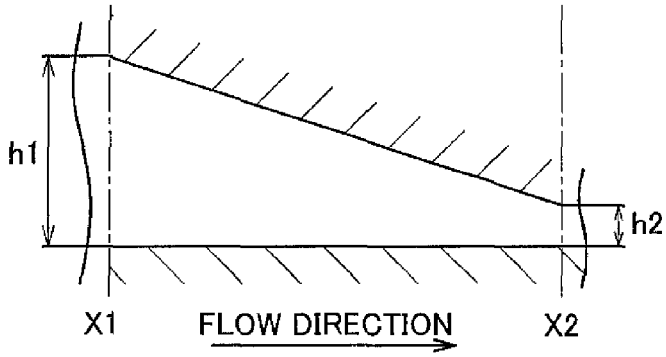
FIG. 6 is a view showing a frame format of the manner in which hydraulic fluid flows through the narrowing flow path formed such that the flow path height continuously decreases.
Figure 7:
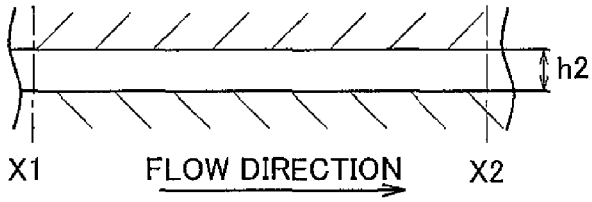
FIG. 7 is a view showing a frame format of the manner in which hydraulic fluid flows through the parallel flow path of a uniform height.

FIG. 5 is a view showing a comparison between the dynamic pressure P [Pa] generated in the hydraulic fluid when hydraulic fluid flows through a narrowing flow path formed such that the flow path height becomes continuously lower from the height h1 to the height h2, as shown in frame format in FIG. 6, and the dynamic pressure P [Pa] generated in the hydraulic fluid when hydraulic fluid flows through a parallel flow path formed such that the flow path height is a uniform height h2 as shown in frame format in FIG. 7. In FIG. 5, the solid line shows the relationship between the dynamic pressure generated in the hydraulic fluid when hydraulic fluid flows through the narrowing flow path, and a flow direction position X in the narrowing flow path. The alternate long and short dash line shows the relationship between the dynamic pressure P generated in the hydraulic fluid when the hydraulic fluid flows through the parallel flow path, and the flow direction position X in the parallel flow path. The dynamic pressure P generated in the hydraulic fluid in each flow path has a distribution such that it gradually increases from a flow direction position X1 toward a flow direction position X2, reaches maximum values P1 and P2 at the area right before the flow direction position X2, and then decreases from the maximum values P1 and P2 toward the flow direction position X2. In this way, no significant difference is visible in the distribution profile of the dynamic pressure in the flow direction between the narrowing flow path and the parallel flow path. However, a significant difference is visible in the amount of the dynamic pressure P that is generated. That is, the dynamic pressure P generated in the narrowing flow path becomes far greater than the dynamic pressure P generated in the parallel flow path. This is due to a so-called wedge effect.

The same may also be said regarding the difference in the generated dynamic pressures when comparing a case in which a plurality of the convex portions 90 are formed on the driven gear 60, and consequently, a narrowing flow path is formed in the gap between the driven gear 60 and the pump body 40 by the rising surfaces 92 of the convex portions 90 as in this example embodiment, with a case in which the convex portions 90 are not provided, and consequently, a narrowing flow path is not formed in the gap. That is, the dynamic pressure P generated in the hydraulic fluid that flows through a narrowing path when one is formed in the gap between the driven gear 60 and the pump body 40 as in this example embodiment is far greater than the dynamic pressure P generated in the hydraulic fluid that flows through a gap in which a narrowing flow path is not formed. Therefore, with the oil pump 10 in this example embodiment, a relatively large amount of dynamic pressure P is generated at the six locations where the rising surfaces 92 are located in the gap between the driven gear 60 and the pump body 40. This dynamic pressure P acts as self-aligning force for automatically aligns the driven gear 60 with the axis O1 of the pump chamber 52. Incidentally, one case in which the narrowing flow path is not provided is, for example, a case in which the outer peripheral surface of the driven gear 60 is formed in the shape of a cylindrical surface with no asperities (i.e., concave or convex portions).

Figure 8:
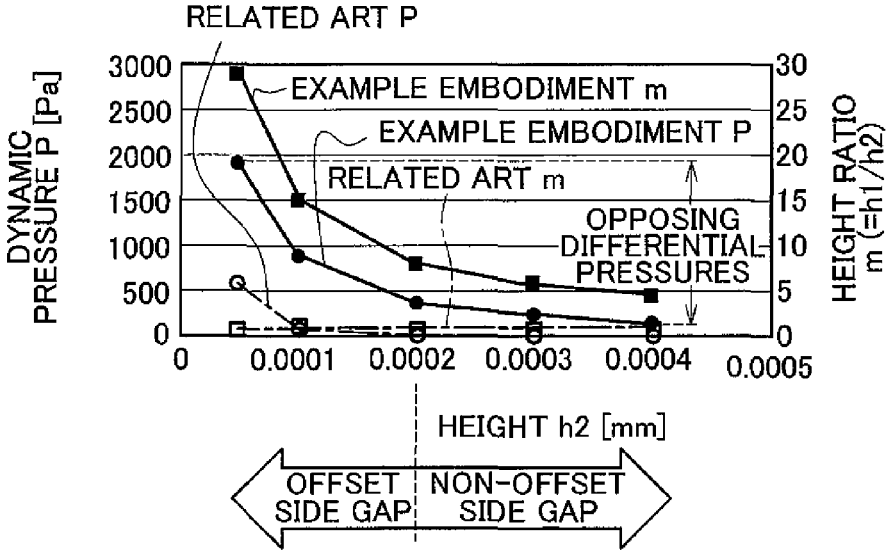
FIG. 8 is a view showing a comparison between the height ratio in the circumferential direction of the gap between the driven gear and the pump body and the dynamic pressure generated in the hydraulic fluid that flows through the gap when a narrowing flow path is provided in the gap by a rising surface, and that height ratio when the narrowing flow path is not provided in the gap.

FIG. 8 is a view showing a comparison between the maximum pressure P generated in the hydraulic fluid that flows through the gap between the driven gear 60 and the pump body 40 and the height ratio m (=h1/h2) of that gap in the circumferential direction of the driven gear 60 when the narrowing flow path is provided in the gap by the rising surfaces 92 as in this example embodiment, and that maximum pressure P and that height ratio when the narrowing flow path is not provided in that gap. The height h1 represents the maximum height of the gap, and the height h2 represents the minimum height of the gap. In FIG. 8, the solid line that connects the black circles shows the relationship between the maximum dynamic pressure P generated in the hydraulic fluid that flows through the narrowing flow path and the minimum height h2 of the narrowing flow path (i.e., the height of the gap between the maximum diameter position p2 of the convex portion 90 and the cylindrical inner peripheral surface 50 of the pump body 40) when the narrowing flow path is provided in the gap by the rising surface 92. The solid line that connects the black squares shows the relationship between the height ratio m (=h1/h2) of the narrowing flow path and the minimum height h2 of the narrowing flow path when a narrowing flow path is provided in the gap by the rising surfaces 92. Also, the alternate long and short dash line that connects the white circles shows the relationship between the maximum dynamic pressure P generated in the hydraulic fluid that flows through the gap and the minimum height h2 of that gap when the convex portions 90 are not provided such that the narrowing flow path is not provided in the gap. The alternate long and short dash line that connects the white squares shows the relationship between the height ratio m (=h1/h2) of the gap and the minimum height h2 of the gap when a narrowing flow path is not provided in the gap.

Figure 9:
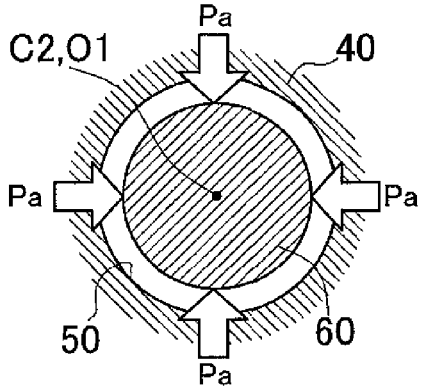
FIG. 9 is a view showing a frame format of pressure from the hydraulic fluid on the driven gear when the rotational center of the driven gear rotates while matching the axis of the circumferential inner peripheral surface of the pump body.

Here, in FIG. 8, when the height h2 is 0.0002 mm (0.2 μm), for example, i.e., when the central rotational axis C2 of the driven gear 60 is aligned with the axis O1 of the cylindrical inner peripheral surface 50 of the pump body 40 as shown in the frame format in FIG. 9, the maximum dynamic pressure P generated at all of the maximum diameter positions of the convex portions 90 is substantially the same. The pressure that is applied to the driven gear 60 by the hydraulic fluid according to the dynamic pressure P, i.e., the pressure with which the driven gear 60 is pushed from the outer peripheral surface of the driven gear 60 toward the central rotational axis C2, does not change at any of the convex portions 90 in the circumferential direction of the driven gear 60, as shown by the arrows "Pa" in FIG. 9.

Figure 10:
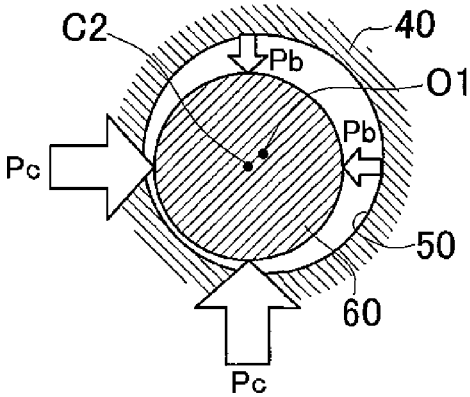
FIG. 10 is a view showing a frame format of pressure from the hydraulic fluid on the driven gear when the driven gear rotates eccentrically with respect to the short cylindrical inner peripheral surface of the pump body.

Also, in FIG. 8, when the height h2 is 0.00005 mm (0.05 μm), for example, i.e., when the central rotational axis C2 of the driven gear 60 is not aligned with the axis O1 of the cylindrical inner peripheral surface 50 of the pump body 40, as shown in the frame format in FIG. 10, but is instead 0.00015 mm (0.15 μm) offset from that axis O1, the dynamic pressure P generated in the hydraulic fluid that flows through the gap increases as the height h2 decreases. The pressure that is applied to the driven gear 60 by the hydraulic fluid according to the dynamic pressure P, i.e., the pressure with which the driven gear 60 is pushed from the outer peripheral surface of the driven gear 60 toward the central rotational axis C2, increases as the height h2 decreases, as shown by the arrows "Pb" and "Pc" in FIG. 10.

As shown in FIG. 8, when the narrowing flow path is provided in the gap between the driven gear 60 and the pump body 40, the maximum dynamic pressure P generated in the hydraulic fluid that flows through the gap becomes far greater than it does when the narrowing flow path is not provided in the gap. Then, the dynamic pressure P increases in a quadratic curve as the degree of offset in the driven gear 60 with respect to the pump body 40 increases.

Figure 11:
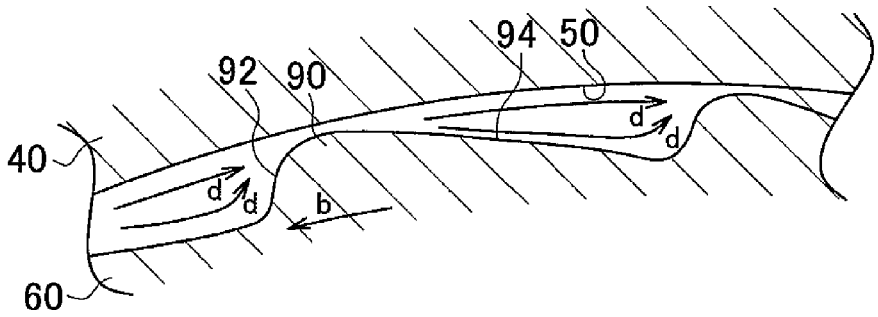
FIG. 11 is a view showing a frame format of a portion in the circumferential direction of the pump body and the driven gear shown in FIG. 2.

FIG. 11 is a view showing a frame format of a portion in the circumferential direction of the pump body 40 and the driven gear 60 in the first example embodiment of the invention shown in FIG. 2. As shown in FIG. 11, with the oil pump 10 in this example embodiment, when the driven gear 60 is rotated in the direction indicated by arrow "b" in FIG. 11, the flow lines of the hydraulic fluid that flows through the gap formed between the driven gear 60 and the pump body 40 do not peel, as shown by the arrow "d", and thus a vortex does not develop. Accordingly, because peeling does not occur in the flow of hydraulic fluid in the gap between the falling surface 94 and the pump body 40, the pressure of the hydraulic fluid in that gap is inhibited from suddenly decreasing. As a result, the pressure difference in the hydraulic fluid in the circumferential direction is inhibited from increasing. Because peeling does not occur in the flow of hydraulic fluid due to the fact that the rising surface 92 of the convex portion 90 is shaped so that it approaches the cylindrical inner peripheral surface 50 of the pump body 40, the surface of the convex portion 90 is shaped such that peeling does not occur in the flow of the hydraulic fluid that flows between the surface of the convex portion 90 and the cylindrical inner peripheral surface 50 of the pump body 40.

Figure 12:
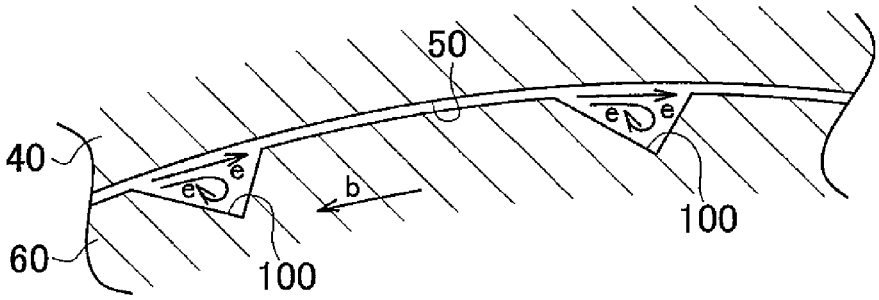
FIG. 12 RELATED ART
FIG. 12 is a view showing a frame format of a portion in the circumferential direction of the pump body and the driven gear in an oil pump in a related technical field.

FIG. 12 is a view showing a frame format of a portion in the circumferential direction of the pump body 40 and the driven gear 60 in an oil pump in a related technical field. In FIG. 12, a plurality of concave portions 100, in which the cross section that is orthogonal to the central rotational axis C2 is step-shaped, are provided at predetermined intervals in the circumferential direction, instead of the convex portions 90 in this example embodiment, on the outer peripheral surface of the driven gear 60 of a related oil pump. As shown in FIG. 12, with this oil pump, when the driven gear 60 is rotated in the direction indicated by the arrow "b" in FIG. 12, the flow lines of the hydraulic fluid that flows through the gap formed between the driven gear 60 and the pump body 40 peel as shown by the arrow "e", such that a vortex develops. That is, the flow of the hydraulic fluid peels, such that a vortex develops, at the location where the gap formed between the driven gear 60 and the pump body 40 increases in the direction opposite the rotational direction of the driven gear 60. As a result, the pressure of the hydraulic fluid suddenly decreases at that location, such that the pressure difference in the hydraulic fluid in the circumferential direction increases.

With the internal gear oil pump 10 for a vehicle according to the first example embodiment of the invention, the plurality of convex portions 90 that protrude radially outward from a plurality of positions separated in the circumferential direction are provided on the outer peripheral surface of the driven gear 60. Each convex portion 90 has the rising surface 92 and the falling surface 94 in the circumferential direction of the driven gear 60. The rising surface 92 rises from the minimum diameter position p1 to the maximum diameter portion p2 in the direction opposite the rotational direction of the driven gear 60. The falling surface 94 falls from the maximum diameter position p2 to the minimum diameter position p1 that is adjacent to and in back of that maximum diameter position p2 with respect to the rotational direction of the driven gear 60. The circumferential length L2 of the falling surface 94 is greater than the circumferential length L1 of the rising surface 92. That is, the rising surface 92 is formed such that the thickness in the radial direction of the driven gear 60 strictly increases from the minimum diameter position p1 that is in front of the maximum diameter position p2 with respect to the rotational direction of the driven gear 60, to the maximum diameter position p2, and the falling surface 94 is formed such that the thickness in the radial direction of the driven gear 60 strictly decreases from the maximum diameter position p2 to the minimum diameter position p1 that is in back of the maximum diameter position p2 with respect to the rotational direction of the driven gear 60. Accordingly, a relatively large amount of dynamic pressure P is generated in the hydraulic fluid that flows between the rising surface 92 of the convex portion 90 and the pump body 40, so the self-aligning ability of the driven gear 60 is improved. In addition, the height of the gap formed between the falling surface 94 of the convex portion 90 and the pump body 40 gradually increases in the direction opposite the rotational direction of the driven gear 60, which inhibits the hydraulic fluid that flows through that gap from peeling. As a result, an increase in the pressure difference in the circumferential direction in the hydraulic fluid that flows between the driven gear 60 and the pump body 40 due to that peeling is inhibited, which in turn inhibits the pressure drag (i.e., pressure resistance) that acts on the driven gear 60 in a manner that impedes the rotation of the driven gear 60 from increasing. Thus, the rotational resistance of the driven gear 60 can be reduced. Also, because the rotational resistance of the driven gear 60 is reduced, the rotational resistance (i.e., the axial torque resistance) of the drive gear 68 can also be reduced.

Figure 13:
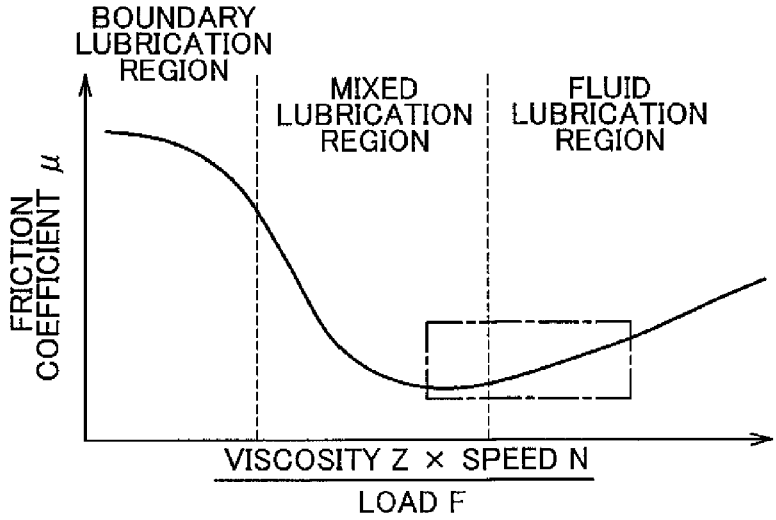
FIG. 13 is a graph in which the solid line represents a so-called Stribeck curve in a Cartesian (orthogonal) coordinate system with a horizontal axis that represents the quotient of the product of the viscosity of the hydraulic fluid that flows through the gap between the driven gear and the pump body multiplied by the sliding speed of the driven gear and the pump body, divided by the external force, i.e., the load, applied to the driven gear, and the vertical axis represents the friction coefficient between the driven gear and the pump body.

In this example embodiment, the self-aligning ability of the driven gear 60 is improved as described above, so even when the rotation speed is low or a large amount of hydraulic pressure is generated, the oil pump 10 operates in the region shown by the alternate long and short dash line in FIG. 13. That is, with the oil pump 10 in this example embodiment, the lubrication state between the driven gear 60 and the pump body 40 is maintained in a mixed lubrication state or a fluid lubrication state, and thus is inhibited from becoming a boundary lubrication state, so an increase in friction loss can be suppressed. As a result, the rotational resistance of the driven gear 60 can be reduced. The fluid lubrication state is a state in which the driven gear 60 is rotatably driven without contacting the pump body 40, and in which the height h2 of the gap formed between the driven gear 60 and the pump body 40, i.e., the oil film thickness, is sufficiently large compared with the surface roughness R [μm] of the outer peripheral surface of the driven gear 60 and the cylindrical inner peripheral surface 50 of the pump body 40 (i.e., h2>R). Also, the boundary lubrication state is a state in which the driven gear 60 is rotatably driven while contacting the pump body 40, and in which the height h2 of the gap formed between the driven gear 60 and the pump body 40, i.e., the oil film thickness, is zero or near zero (i.e., h2<R). Also, the mixed lubrication state is a state in between the fluid lubrication state and the boundary lubrication state, and in which the height h2, i.e., the oil film thickness, is substantially equal to the surface roughness R [μm] of the outer peripheral surface of the driven gear 60 and the cylindrical inner peripheral surface 50 of the pump body 40 (i.e., h2≈R). Incidentally, FIG. 13 is a graph in which the solid line represents a so-called Stribeck curve in a Cartesian (orthogonal) coordinate system with a horizontal axis that represents the quotient of the product of the viscosity Z of the hydraulic fluid that flows through the gap between the driven gear 60 and the pump body 40 multiplied by the sliding speed N of the driven gear 60 and the pump body 40, divided by the external force, i.e., the load F, applied to the driven gear 60, and the vertical axis represents the friction coefficient μ between the driven gear 60 and the pump body 40. This Stribeck curve shows the change in the friction coefficient μ with respect to the load F and the sliding speed N. In FIG. 13, the boundary lubrication region, the mixed lubrication region, and the fluid lubrication region are divided in that order in the direction in which the value of the horizontal axis (i.e., Z×N/F) increases, and the Stribeck curve is such that the friction coefficient μ is the smallest on the fluid lubrication region side of the mixed lubrication region. The region shown by the alternate long and short dash line is set straddling the mixed lubrication region and the fluid lubrication region, so the oil pump 10 in this example embodiment that operates within the region indicated by the alternate long and short dash line operates with a low friction coefficient μ.

Also, with the internal gear oil pump 10 for a vehicle according to this example embodiment, the surface of each convex portion 90 is formed such that peeling will not occur in the flow lines of the hydraulic fluid that flows between the surface of the convex portion 90 and the pump body 40. Accordingly, the flow of the hydraulic fluid in the gap between the driven gear 60 and the pump body 40 becomes smooth, thereby inhibiting the pressure drag of the driven gear 60 from increasing due to that peeling. As a result, the rotational resistance of the driven gear 60 can be reduced.

Further, with the internal gear oil pump 10 for a vehicle according to this example embodiment, the falling surface 94 of the each convex portion 90 is formed in a streamlined shape in the circumferential direction of the driven gear 60. Accordingly, peeling in the hydraulic fluid that flows through the gap between the falling surface 94 of each convex portion 90 and the pump body 40 can be inhibited, which in turn inhibits a vortex from developing in the flow of the hydraulic fluid in that gap. As a result, the pressure drag of the driven gear 60 can be inhibited from increasing due to the vortex (i.e., peeling) of the hydraulic fluid, which enables the rotational resistance of the driven gear 60 to be reduced.

Also, with internal gear oil pump 10 for a vehicle according to this example embodiment, the rising surface 92 of the convex portion 90 rises from the minimum diameter position p1 that coincides with the terminal end position of the streamlined shape of the falling surface 94 of the convex portion 90 that is adjacent to and in front of that rising surface 92 in the rotational direction of the driven gear 60. Therefore, for example, compared to when the rising surface 92 of the convex portion 90 is formed rising from a position in back of, in the rotational direction of the driven gear 60, the minimum diameter position p1 that coincides with the terminal end position of the streamlined shape of the convex portion 90 that is adjacent to and in front of the rising surface 92 in the rotational direction of the driven gear 60, the pressure difference in the hydraulic fluid that flows through the gap between the driven gear 60 and the pump body 40 is less so the pressure drag acting on the driven gear 60 is less, which enables the rotational resistance of the driven gear 60 to be further reduced.

Next, second to fifth example embodiments of the invention will be described. Incidentally, in the description of the example embodiments below, portions that are the same as or similar to those in the example embodiment described above will be denoted by like reference characters and descriptions of those portions will be omitted.

Figure 14:
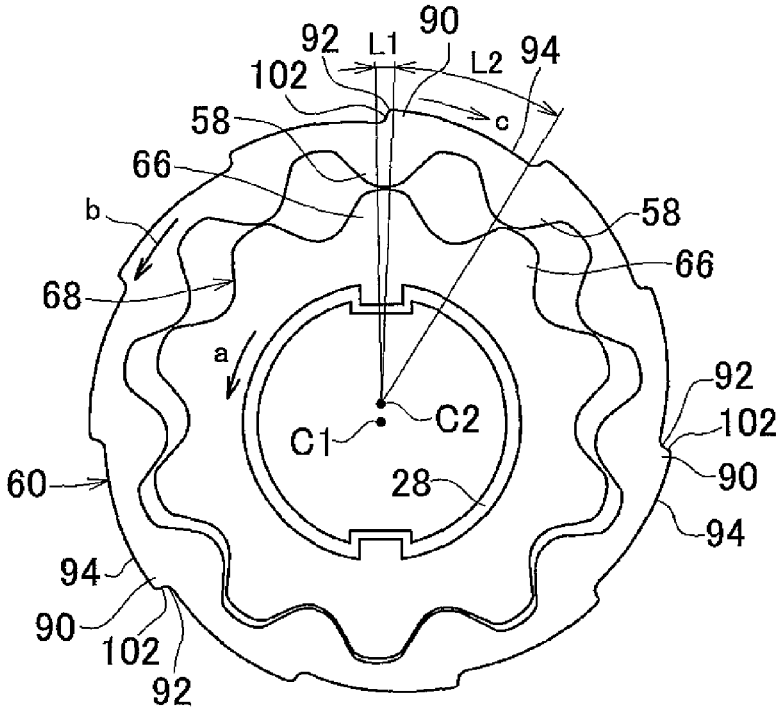
FIG. 14 is an enlarged view of the drive gear and the driven gear of an internal gear oil pump for a vehicle according to a second example embodiment of the invention, which corresponds to FIG. 3.
Figure 15:
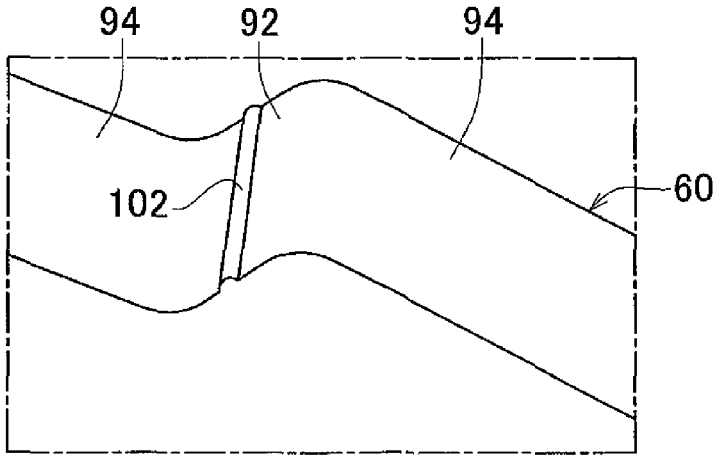
FIG. 15 is a partial perspective view of a rising surface, and the area there around, of the driven gear shown in FIG. 14.

FIG. 14 is an enlarged view of the drive gear 68 and the driven gear 60 in the internal gear oil pump 10 for a vehicle according to a second example embodiment of the invention, which corresponds to FIG. 3 of the first example embodiment described above. FIG. 15 is partial perspective view of the rising surface 92, and the area there around, of the driven gear 60 shown in FIG. 14. As shown in FIGS. 14 and 15, a plurality (11 in this example embodiment) of convex portions 90 that protrude radially outward from a plurality of positions equal distances apart in the circumferential direction are provided on the outer peripheral surface of the driven gear 60 in this example embodiment. A small protrusion 102 that extends in the width direction of the driven gear 60, i.e., in a direction parallel to the central rotational axis C2 of the driven gear 60, is provided in the center, in the circumferential direction of the rising surface 92, of the rising surface 92 of the convex portion 90. This small protrusion 102 serves as a small turbulence generating portion for generating a small amount of turbulence that shifts the peeling position of the flow lines of the hydraulic fluid back with respect to the rotational direction of the driven gear 60, by causing a turbulence transition that changes the flow of hydraulic fluid near the surface of the convex portion 90 between the convex portion 90 and the pump body 40 (see FIG. 2) from a laminar flow to a turbulent flow. This protruding portion 102 is formed such that the cross section that is orthogonal to the width direction of the driven gear 60 is in the shape of a semicircle, as shown in FIG. 15.

With the oil pump 10 provided with the driven gear 60 that has this kind of small protrusion 102, when the driven gear 60 is rotated, the hydraulic fluid in the annular gap formed between the driven gear 60 and the pump body 40 is dragged by the rotation of the driven gear 60 so that it moves through the gap in the circumferential direction. When the hydraulic fluid flows through the gap on the outer peripheral side of the falling surface 94 where the height of the annular gap gradually increases in the direction opposite the rotational direction of the driven gear 60, the flow of the hydraulic fluid is inhibited from peeling because the height of the gap gradually increases as described above. Furthermore, in this example embodiment, generating a small amount of turbulence on the downstream side of the small protrusion 102 formed on the rising surface 92 shifts the peeling position (i.e., the position of the boundary layer that is the point of origin for peeling) of the hydraulic fluid between the falling surface 94 and the pump body 40 back with respect to the rotational direction of the driven gear 60, thereby inhibiting peeling. In other words, the small amount of turbulence generated on the downstream side of the small protrusion 102 acts to shift the peeling position of the hydraulic fluid that flows on the outer peripheral side of the falling surface 94 that is positioned on the downstream side of the small protrusion 102 back with respect to the rotational direction of the driven gear 60 (i.e., toward the downstream side). As a result, peeling can be further inhibited from occurring compared to when the small protrusion 102 is not formed on the rising surface 92, as in the first example embodiment described above, for example.

Figure 16:
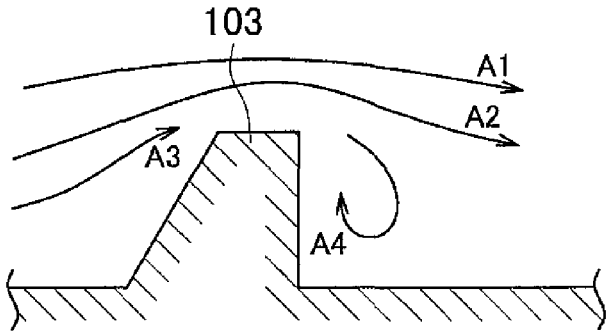
FIG. 16 is a view showing a frame format of the flow lines, indicated by arrows, of the hydraulic fluid that flows through a flow path provided with a convex portion formed protruding out in a direction orthogonal to the flow.
Figure 17:
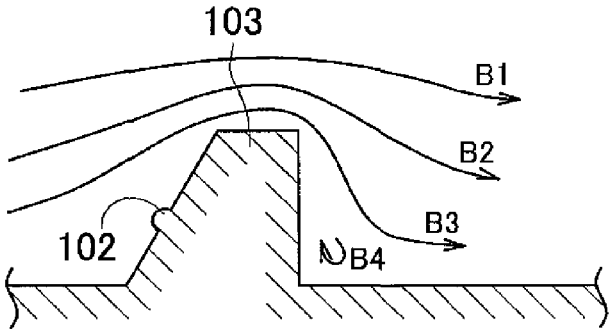
FIG. 17 is a view showing a frame format of the flow lines, indicated by arrows, of the hydraulic fluid that flows through in a flow path provided with a convex portion formed protruding out in a direction orthogonal to the flow, and a small protruding portion as a small turbulence generating portion on the upstream side of an outer peripheral surface of the convex portion.

Next, the manner in which peeling of the hydraulic fluid is inhibited by the small protrusion 102 that serves as the small turbulence generating portion will be described. FIG. 16 is a view showing a frame format of the flow lines, indicated by arrows A1 to A4, of the hydraulic fluid that flows through a flow path provided with a convex portion 103 formed protruding out in a direction orthogonal to the flow, for example. When the hydraulic fluid flows through a flow path such as that shown in FIG. 16, peeling of the hydraulic fluid may occur as shown by arrow A4, at the location where the flow path height on the downstream side of the convex portion 103 suddenly increases. In contrast, FIG. 17 is a view showing a frame format of the flow lines, indicated by arrows B1 to B4, of the hydraulic fluid that flows through a flow path provided with the convex portion 103 shown in FIG. 16, and a small protruding portion 102 that serves as a small turbulence generating portion on the upstream side of the outer peripheral surface of the convex portion 103. When the hydraulic fluid flows through a flow path such as that shown in FIG. 17, the flow on the downstream side of the small protrusion 102 is changed from a laminar flow to a turbulent flow by the small protrusion 102, such that a small amount of turbulence is produced along the surface of the convex portion 103. As a result, a flow is produced that wraps around the convex portion 103 from the tip end portion to the base end portion thereof, as shown by arrow B3, at the location where the flow path height on the downstream side of the convex portion 103 suddenly increases. Accordingly, even if peeling occurs as shown by arrow B4, that peeling of the hydraulic fluid will be small. Therefore, peeling on the downstream side of the small protrusion 102 can be inhibited by the small protrusion 102. The same may also be said for peeling being inhibited with the small protrusion 102 provided on the rising surface 92 of the convex portion 90 of the driven gear 60 in this example embodiment.

With the internal gear oil pump 10 for a vehicle according to this example embodiment, the structure other than the small protrusion 102 being formed on the rising surface 92 is the same as that in the first example embodiment described above. The plurality of convex portions 90 that protrude radially outward from a plurality of positions separated in the circumferential direction are provided on the outer peripheral surface of the driven gear 60. Each convex portion 90 has the rising surface 92 and the falling surface 94 in the circumferential direction of the driven gear 60. The rising surface 92 rises from the minimum diameter position p1 to the maximum diameter position p2 in the direction opposite the rotational direction of the driven gear 60, and the falling surface 94 falls from the maximum diameter position p2 to the minimum diameter position p1 that is adjacent to and in back of that maximum diameter position p2 with respect to the rotational direction of the driven gear 60. Further, the circumferential length L2 of the falling surface 94 is greater than the circumferential length of the rising surface 92. Accordingly, the rotational resistance of the driven gear 60 and the drive gear 68 is able to be reduced, just as in the first example embodiment.

Also, with the internal gear oil pump 10 for a vehicle according to this example embodiment, the small protrusion 102 is provided on the rising surface 92 of the convex portion 90 as a small turbulence generating portion for generating a small amount of turbulence that shifts the peeling position of the flow lines of the hydraulic fluid back with respect to the rotational direction of the driven gear 60 by causing a turbulence transition in the flow of hydraulic fluid that flows between the convex portion 90 and the pump body 40. As a result, compared with when the small protrusion 102 is not provided, the peeling position (i.e., the position of the boundary layer that is the point of origin for peeling) of the hydraulic fluid between the falling surface 94 and the pump body 40 is shifted back with respect to the rotational direction of the driven gear 60, such that peeling is inhibited. Accordingly, an increase in pressure drag that acts on the driven gear 60 due to that peeling can also be suppressed, which enables the rotational resistance of the driven gear 60 to be reduced. Also, compared with when the small protrusion 102 is not provided, peeling can be inhibited even if the gradient of the falling surface 94 of the convex portion 90 is steep, which increases the degree of freedom of the arrangement of the convex portions 90 on the outer peripheral surface of the driven gear 60. For example, an even larger number of convex portions 90 may be arranged on the outer peripheral surface of the driven gear 60. As a result, the self-aligning ability of the driven gear 60 can be further improved. Also, arranging an even larger number of convex portions 90 on the outer peripheral surface of the driven gear 60 makes it possible to optimize the balance of generated dynamic pressure P for automatically aligning the driven gear 60.

Further, with the internal gear oil pump 10 for a vehicle according to this example embodiment, the small protrusion 102 is a small protrusion that extends in the width direction of the driven gear 60, so when the driven gear 60 is manufactured by molding or the like by sintering (powder metallurgy), for example, the small protrusion 102 can be integrally formed with the driven gear 60 relatively easily at that time (i.e., during molding), which enables the driven gear 60 to be manufactured cheaply.

Figure 18:
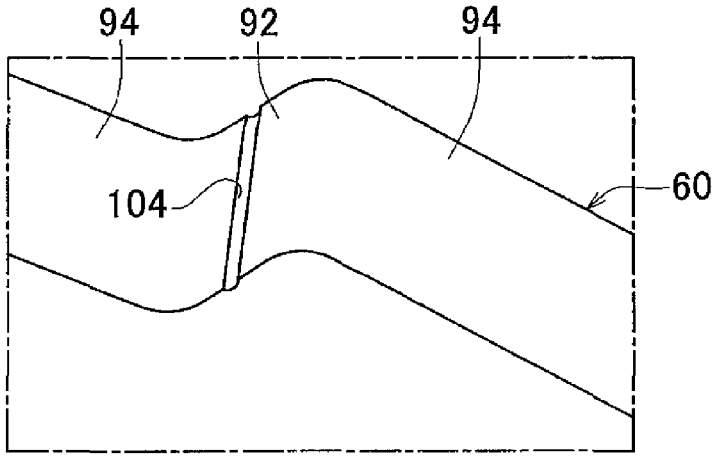
FIG. 18 is a partial perspective view of a rising surface, and the area there around, of the driven gear shown in FIG. 14 in an internal gear oil pump for a vehicle according to a third example embodiment of the invention, which corresponds to FIG. 15.

FIG. 18 is a partial perspective view of the rising surface 92, and the area there around, of the driven gear 60 shown in FIG. 14 in an internal gear oil pump 10 for a vehicle according to a third example embodiment of the invention, which corresponds to FIG. 15 of the second example embodiment described above. As shown in FIG. 18, a plurality (11 in this example embodiment) of convex portions 90 that protrude radially outward from a plurality of positions equal distances apart in the circumferential direction are provided on the outer peripheral surface of the driven gear 60 of this example embodiment. A groove 104 that extends in the width direction of the driven gear 60 is provided in the center, in the circumferential direction of the rising surface 92, of the rising surface 92 of the convex portion 90. This groove 104 serves as a small turbulence generating portion for generating a small amount of turbulence to shift the peeling position of the flow lines of the hydraulic fluid back with respect to the rotational direction of the driven gear 60 by causing a turbulence transition in the flow of the hydraulic fluid that flows between the convex portion 90 and the pump body 40 (see FIG. 2). This groove 104 is formed such that the cross section that is orthogonal to the width direction of the driven gear 60 is in the shape of a semicircle, as shown in FIG. 18.

With the oil pump 10 provided with the driven gear 60 that has this kind of groove 104, when the driven gear 60 is rotated, the hydraulic fluid in the annular gap formed between the driven gear 60 and the pump body 40 is dragged by the rotation of the driven gear 60 so that it moves through the gap in the circumferential direction. When the hydraulic fluid flows through the gap on the outer peripheral side of the falling surface 94 where the height of the annular gap gradually increases in the direction opposite the rotational direction of the driven gear 60, the flow of the hydraulic fluid is inhibited from peeling because the height of the gap gradually increases as described above. Furthermore, in this example embodiment, generating a small amount of turbulence on the downstream side of the groove 104 formed in the rising surface 92 shifts the peeling position (i.e., the position of the boundary layer that is the point of origin for peeling) of the hydraulic fluid between the falling surface 94 and the pump body 40 back with respect to the rotational direction of the driven gear 60, thereby inhibiting peeling. In other words, the small amount of turbulence generated on the downstream side of the groove 104 acts to shift the peeling position of the hydraulic fluid that flows on the outer peripheral side of the falling surface 94 that is positioned on the downstream side of the groove 104 back with respect to the rotational direction of the driven gear 60 (i.e., toward the downstream side). As a result, peeling can be further inhibited from occurring compared to when the groove 104 is not formed in the rising surface 92, as in the first example embodiment described above, for example.

With the internal gear oil pump 10 for a vehicle according to this example embodiment, the structure other than the groove 104 being formed in the rising surface 92 is the same as that in the first example embodiment described above. Accordingly, the rotational resistance of the driven gear 60 and the drive gear 68 is able to be reduced, just as in the first example embodiment.

Also, with the internal gear oil pump 10 for a vehicle according to this example embodiment, the groove 104 is provided in the rising surface 92 of the convex portion 90 as a small turbulence generating portion for generating a small amount of turbulence that shifts the peeling position of the flow lines of the hydraulic fluid back with respect to the rotational direction of the driven gear 60 by causing a turbulence transition in the flow of hydraulic fluid that flows between the convex portion 90 and the pump body 40. As a result, just as with the second example embodiment, compared with when the groove 104 is not provided, the rotational resistance of the driven gear 60 can be reduced. Moreover, for example, an even larger number of convex portions 90 may be arranged on the outer peripheral surface of the driven gear 60, which enables the self-aligning ability of the driven gear 60 to be further improved and makes it possible to optimize the balance of generated dynamic pressure P for automatically aligning the driven gear 60.

Also, with the internal gear oil pump 10 for a vehicle according to this example embodiment, the groove 104 is a groove that extends in the width direction of the driven gear 60, so when the driven gear 60 is manufactured by molding or the like by sintering (powder metallurgy), for example, the groove 104 can be formed in the driven gear 60 relatively easily at that time (i.e., during molding), which enables the driven gear 60 to be manufactured cheaply.

Figure 19:
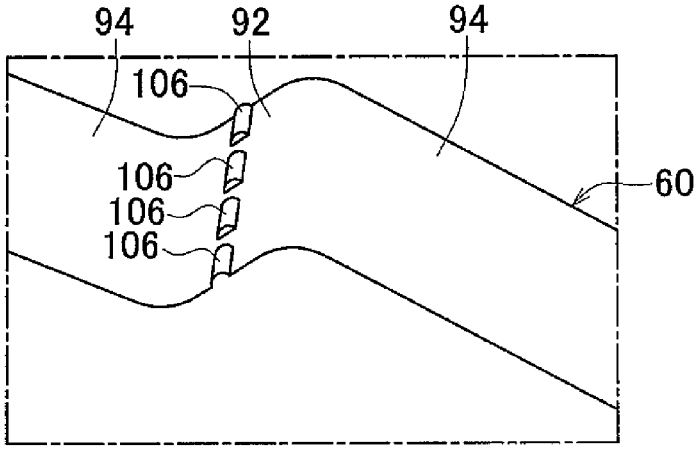
FIG. 19 is a partial perspective view of a rising surface, and the area there around, of the driven gear shown in FIG. 14 in an internal gear oil pump for a vehicle according to a fourth example embodiment of the invention, which corresponds to FIG. 15.

FIG. 19 is a partial perspective view of the rising surface 92, and the area there around, of the driven gear 60 shown in FIG. 14 in an internal gear oil pump 10 for a vehicle according to a fourth example embodiment of the invention, which corresponds to FIG. 15 of the second example embodiment described above. As shown in FIG. 19, a plurality (11 in this example embodiment) of convex portions 90 that protrude radially outward from a plurality of positions equal distances apart in the circumferential direction are provided on the outer peripheral surface of the driven gear 60 of this example embodiment. A plurality (four in this example embodiment) of small protrusions 106 that are arranged at predetermined intervals in the width direction of the driven gear 60 are provided in the center, in the circumferential direction of the rising surface 92, of the rising surface 92 of the convex portion 90. The plurality of small protrusions 106 serve as a small turbulence generating portion for generating a small amount of turbulence to shift the peeling position of the flow lines of the hydraulic fluid back with respect to the rotational direction of the driven gear 60 by causing a turbulence transition in the flow of the hydraulic fluid that flows between the convex portion 90 and the pump body 40 (see FIG. 2). The plurality of small protrusions 106 are formed such that the cross sections that are orthogonal to the width direction of the driven gear 60 are in the shape of a semicircle, as shown in FIG. 17.

With the oil pump 10 provided with the driven gear 60 that has this kind of a plurality of small protrusions 106, when the driven gear 60 is rotated, the hydraulic fluid in the annular gap formed between the driven gear 60 and the pump body 40 is dragged by the rotation of the driven gear 60 so that it moves through the gap in the circumferential direction. When the hydraulic fluid flows through the gap on the outer peripheral side of the falling surface 94 where the height of the annular gap gradually increases in the direction opposite the rotational direction of the driven gear 60, the flow of the hydraulic fluid is inhibited from peeling because the height of the gap gradually increases as described above. Furthermore, in this example embodiment, generating a small amount of turbulence on the downstream side of the plurality of small protrusions 106 formed on the rising surface 92 shifts the peeling position (i.e., the position of the boundary layer that is the point of origin for peeling) of the hydraulic fluid between the falling surface 94 and the pump body 40 back with respect to the rotational direction of the driven gear 60, thereby inhibiting peeling. In other words, the small amount of turbulence generated on the downstream side of the plurality of small protrusions 106 acts to shift the peeling position of the hydraulic fluid that flows on the outer peripheral side of the falling surface 94 that is positioned on the downstream side of the plurality of small protrusions 106 back with respect to the rotational direction of the driven gear 60 (i.e., toward the downstream side). As a result, peeling can be further inhibited from occurring compared to when the plurality of small protrusions 106 are not formed on the rising surface 92, as in the first example embodiment described above, for example.

With the internal gear oil pump 10 for a vehicle according to this example embodiment, the structure other than the plurality of small protrusions 106 being formed on the rising surface 92 is the same as that in the first example embodiment described above. Accordingly, the rotational resistance of the driven gear 60 and the drive gear 68 is able to be reduced, just as in the first example embodiment.

Also, with the internal gear oil pump 10 for a vehicle according to this example embodiment, the plurality of small protrusions 106 are provided on the rising surface 92 of the convex portion 90 as a small turbulence generating portion for generating a small amount of turbulence that shifts the peeling position of the flow lines of the hydraulic fluid back with respect to the rotational direction of the driven gear 60 by causing a turbulence transition in the flow of hydraulic fluid that flows between the convex portion 90 and the pump body 40. As a result, just as with the second example embodiment, compared with when the plurality of small protrusions 106 are not provided, the rotational resistance of the driven gear 60 can be reduced. Moreover, for example, an even larger number of convex portions 90 may be arranged on the outer peripheral surface of the driven gear 60, which enables the self-aligning ability of the driven gear 60 to be further improved and makes it possible to optimize the balance of generated dynamic pressure P for automatically aligning the driven gear 60.

Also, with the internal gear oil pump 10 for a vehicle according to this example embodiment, the plurality of small protrusions 106 are a plurality of small protrusions that are arranged at predetermined intervals in the width direction of the driven gear 60, so when the driven gear 60 is manufactured by molding or the like by sintering (powder metallurgy), for example, the small protrusions 106 can be integrally formed with the driven gear 60 relatively easily at that time (i.e., during molding), which enables the driven gear 60 to be manufactured cheaply.

Figure 20:
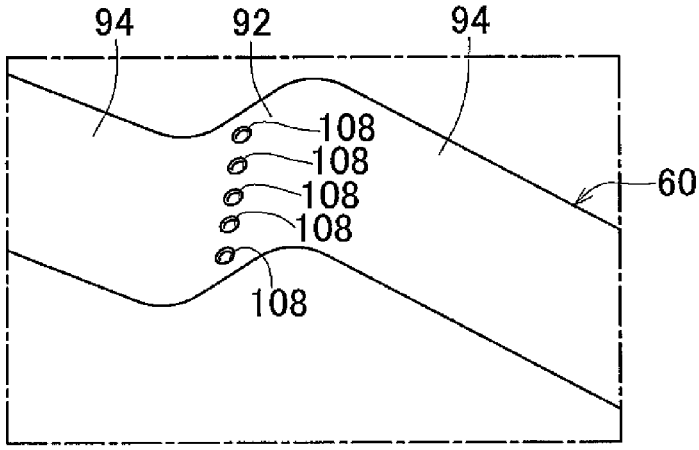
FIG. 20 is a partial perspective view of a rising surface, and the area there around, of the driven gear shown in FIG. 14 in an internal gear oil pump for a vehicle according to a fifth example embodiment of the invention, which corresponds to FIG. 15.
Figure 21:
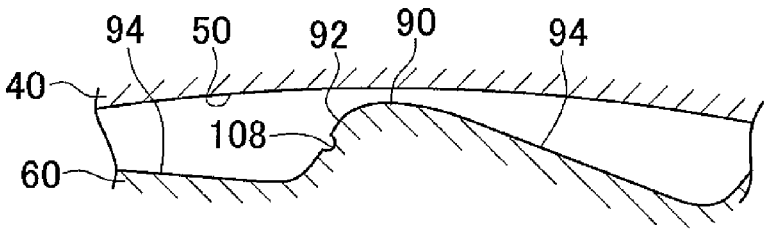
FIG. 21 is a sectional view of the pump body and the convex portion of the driven gear shown in FIG. 18, in a direction orthogonal to the width direction of the driven gear.

FIG. 20 is a partial perspective view of the rising surface 92, and the area there around, of the driven gear 60 shown in FIG. 14 in an internal gear oil pump 10 for a vehicle according to a fifth example embodiment of the invention, which corresponds to FIG. 15 of the second example embodiment described above. FIG. 21 is a sectional view of the pump body 40 and the convex portion 90 of the driven gear 60 shown in FIG. 18, in a direction orthogonal to the width direction of the driven gear 60. As shown in FIGS. 20 and 21, a plurality (11 in this example embodiment) of convex portions 90 that protrude radially outward from a plurality of positions equal distances apart in the circumferential direction are provided on the outer peripheral surface of the driven gear 60 of this example embodiment. A plurality (five in this example embodiment) of small holes 108 arranged at predetermined intervals in the width direction of the driven gear 60 are provided in the center, in the circumferential direction of the rising surface 92, of the rising surface 92 of the convex portion 90. The plurality of small holes 108 serve as a small turbulence generating portion for generating a small amount of turbulence to shift the peeling position of the flow lines of the hydraulic fluid back with respect to the rotational direction of the driven gear 60 by causing a turbulence transition in the flow of the hydraulic fluid that flows between the convex portion 90 and the pump body 40 (see FIG. 2). Each one of the plurality of small holes 108 is formed in a hemispherical shape, as shown in FIG. 20.

With the oil pump 10 provided with the driven gear 60 that has this kind of a plurality of small holes 108, when the driven gear 60 is rotated, the hydraulic fluid in the annular gap formed between the driven gear 60 and the pump body 40 is dragged by the rotation of the driven gear 60 so that it moves through the gap in the circumferential direction. When the hydraulic fluid flows through the gap on the outer peripheral side of the falling surface 94 where the height of the annular gap gradually increases in the direction opposite the rotational direction of the driven gear 60, the flow of the hydraulic fluid is inhibited from peeling because the height of the gap gradually increases as described above. Furthermore, in this example embodiment, generating a small amount of turbulence on the downstream side of the plurality of small holes 108 formed in the rising surface 92 shifts the peeling position (i.e., the position of the boundary layer that is the point of origin for peeling) of the hydraulic fluid between the falling surface 94 and the pump body 40 back with respect to the rotational direction of the driven gear 60, thereby inhibiting peeling. In other words, the small amount of turbulence generated on the downstream side of the plurality of small holes 108 acts to shift the peeling position of the hydraulic fluid that flows on the outer peripheral side of the falling surface 94 that is positioned on the downstream side of the plurality of small grooves 108 back with respect to the rotational direction of the driven gear 60 (i.e., toward the downstream side). As a result, peeling can be further inhibited from occurring compared to when the plurality of small holes 108 are not formed in the rising surface 92, as in the first example embodiment described above, for example.

With the internal gear oil pump 10 for a vehicle according to this example embodiment, the structure other than the plurality of small holes 108 being formed in the rising surface 92 is the same as that in the first example embodiment described above. Accordingly, the rotational resistance of the driven gear 60 and the drive gear 68 is able to be reduced, just as in the first example embodiment.

Also, with the internal gear oil pump 10 for a vehicle according to this example embodiment, the plurality of small holes 108 are provided in the rising surface 92 of the convex portion 90 as a small turbulence generating portion for generating a small amount of turbulence that shifts the peeling position of the flow lines of the hydraulic fluid back with respect to the rotational direction of the driven gear 60 by causing a turbulence transition in the flow of hydraulic fluid that flows between the convex portion 90 and the pump body 40. As a result, just as with the second example embodiment, compared with when the plurality of holes 108 are not provided, the rotational resistance of the driven gear 60 can be reduced. Moreover, for example, an even larger number of convex portions 90 may be arranged on the outer peripheral surface of the driven gear 60, which enables the self-aligning ability of the driven gear 60 to be further improved and makes it possible to optimize the balance of generated dynamic pressure P for automatically aligning the driven gear 60.

Also, with the internal gear oil pump 10 for a vehicle according to this example embodiment, the plurality of small holes 108 are a plurality of small holes that are arranged in the width direction of the driven gear 60, so when the driven gear 60 is manufactured by molding or the like by sintering (powder metallurgy), for example, the plurality of small holes 108 can be formed in the driven gear 60 relatively easily at that time (i.e., during molding), which enables the driven gear 60 to be manufactured cheaply.

While example embodiments of the invention have heretofore been described in detail with reference to the drawings, the invention is not limited to these example embodiments, but may be carried out in other modes as well.

For example, in the example embodiments described above, the falling surface 94 of the convex portion 90 is formed having a streamlined cross-section orthogonal to the rotational axis C2, but the invention is not limited to this. For example, the falling surface 94 may also be formed having a curved or generally straight cross-section orthogonal to the rotational axis C2. In other words, as long as the falling surface 94 is formed such that the circumferential length L2 of the falling surface 94 that falls in a continuous manner from the maximum diameter position p2 to the minimum diameter position p1 in the circumferential direction on the outer peripheral surface of the driven gear 60 is longer than the circumferential length L1 of the rising surface 92 that rises in a continuous manner from the minimum diameter position p1 that is on the upstream side of the falling surface 94 to the maximum diameter position p2, and the height of the gap between the falling surface 94 and the cylindrical inner peripheral surface 50 of the pump body 40 gradually increases toward the downstream side of the flow of hydraulic fluid in that gap, peeling is able to be inhibited. Accordingly, the pressure drag that acts on the driven gear 60 can be inhibited from increasing due to that peeling, so a certain degree of effect is obtained.

Also, in the example embodiments described above, the rising surface 92 is formed so that it rises from the minimum diameter position p1 that coincides with the terminal end of the streamlined shape of the falling surface 94 that is adjacent to and in front of that rising surface 92 with respect to the rotational direction of the driven gear 60. Alternatively, however, the rising surface 92 may be formed so that it rises from a position before the terminal end of the streamlined shape of the falling surface 94 that is adjacent to and in front of that rising surface 92 with respect to the rotational direction of the driven gear 60. Also, the invention is not limited to this. That is, a certain degree of effect is also obtained by forming the rising surface 92 so that it rises from a position farther back, with respect to the rotational direction of the driven gear 60, than the terminal end of the streamlined shape of the falling surface 94 that is adjacent to and in front of that rising surface 92 with respect to the rotational direction of the driven gear 60.

Also, in the example embodiments described above, the small turbulence generating portion provided on the rising surface 92 is a small protrusion 102, a groove 104, a plurality of small protrusions 106, or a plurality of small holes 108, but the invention is not limited to this. For example, the small turbulence generating portion may also be formed by any one of various modes, such as increasing the surface roughness of a portion of the rising surface 92, providing both a protrusion and a groove (or a hole), or attaching a member that is separate from the driven gear 60 to the driven gear 60. In other words, the structure of the small turbulence generating portion is not limited as long as it generates turbulence that shifts the peeling position of the flow lines of the hydraulic fluid that flows between the falling surface 94 of the convex portion 90 and the pump body 40 back with respect to the rotational direction of the driven gear 60.

Also, in the example embodiments described above, the small protrusion 102, the groove 104, the plurality of small protrusions 106, and the plurality of small holes 108 are formed in the center in the circumferential direction of the rising surface 92, but the invention is not limited to this. For example, they may also be formed on the upstream side or the downstream side of the rising surface 92, or formed on the upstream side of the falling surface 94.

Further, in the example embodiments described above, the small protrusion 102 is a single protrusion and the groove 104 is a single groove, each formed extending in the width direction of the driven gear 60 and having a semicircular cross section orthogonal to the width direction, but the invention is not limited to this. For example, the small protrusion 102 and the groove 104 may each be formed extending in the circumferential direction, or a plurality of them may be formed on (in) the rising surface 92. Also, for example, the sectional shapes of the small protrusion 102 and the groove 104 may be rectangular, triangular, or some other mufti-angular shape, and those sectional shapes may change in the width direction.

Also, in the example embodiments described above, the plurality of small protrusions 106 are a plurality of small protrusions and the plurality of small holes 108 are a plurality of small holes, that are arranged in a single line at predetermined intervals in the width direction of the driven gear 60 and have semicircular cross sections orthogonal to the width direction, but the invention is not limited to this. For example, the plurality of small protrusions 106 and the plurality of small holes 108 may be arranged in the circumferential direction, or a plurality of them may be formed on (in) the rising surface 92. Also, for example, the sectional shapes of the plurality of small protrusions 106 and the plurality of small holes 108 may be rectangular, triangular, or some other multi-angular shape, and those sectional shapes may change in the width direction.

Further, in the example embodiments described above, the oil pump 10 is provided in the partition wall between the chamber that houses the torque converter 14 and the chamber that houses the automatic transmission 16, but the invention is not limited to this. For example, the oil pump 10 may also be provided in the automatic transmission 16 or the like. In other words, the invention may be applied to any oil pump 10 that is an internal gear oil pump 10 for a vehicle in which the driven gear 60 and the drive gear 68 are housed in a pump chamber 52.

Also, the invention is not limited to the type of oil pump 10 described above. For example, the invention may also be applied to a type of oil pump in which a crescent-shaped protrusion, which forms a crescent shape by being sandwiched between a partially cylindrical surface that substantially slidingly contacts the internal teeth 58 and a partially cylindrical surface that substantially slidingly contacts the external teeth 66, is formed protruding from the pump body 40, for example, in an arc-shaped gap formed between the external teeth 66 of the drive gear 68 and the internal teeth 58 of the driven gear 60, for example.

Incidentally, the example embodiments described above are no more than examples. While other examples are not illustrated, it is to be understood that the invention may be carried out in modes that have been modified or improved in any of a variety of ways based on the knowledge of one skilled in the art.

What is claimed is:

1. An internal gear oil pump for a vehicle, comprising:

a pump body that has a pump chamber formed by a cylindrical inner peripheral surface;

a driven gear that has an annular shape, that has internal teeth, and is rotatably supported by the cylindrical inner peripheral surface by fitting with the cylindrical inner peripheral surface; and a drive gear that has external teeth that mesh with the internal teeth of the driven gear, is rotatably provided about a rotational center that is offset from the rotational center of the driven gear, and rotatably drives the driven gear, wherein:

a plurality of convex portions that protrude radially outward from a plurality of positions separated in a circumferential direction are formed on an outer peripheral surface of the driven gear;

each convex portion has, in the circumferential direction of the driven gear, a rising surface that rises from a minimum diameter position to a maximum diameter position in a direction opposite a rotational direction of the driven gear, and a falling surface that falls from the maximum diameter position to the minimum diameter position that is adjacent to and in back of the maximum diameter position with respect to the rotational direction of the driven gear; and a circumferential length of the falling surface is greater than a circumferential length of the rising surface.

2. The internal gear oil pump for a vehicle according to claim 1, wherein a surface of each convex portion is formed such that peeling does not occur in flow lines of hydraulic fluid that flows between the falling surface of the convex portion and the pump body.

3. The internal gear oil pump for a vehicle according to claim 1, wherein the falling surface of each convex portion is formed in a streamlined shape in the circumferential direction of the driven gear.

4. The internal gear oil pump for a vehicle according to claim 3, wherein the rising surface of each convex portion is formed so as to rise from a position before a terminal end of the streamlined shape of the falling surface that is adjacent to and in front of the rising surface with respect to the rotational direction of the driven gear, of the convex portion.

5. The internal gear oil pump for a vehicle according to claim 1, wherein a turbulence generating portion for generating turbulence to shift a peeling position of flow lines of hydraulic fluid that flows between each of the convex portions and the pump body back with respect the rotational direction of the driven gear is formed on the rising surface of each convex portion.

6. The internal gear oil pump for a vehicle according to claim 5, wherein the turbulence generating portion is a protrusion that extends in a width direction of the driven gear.

7. The internal gear oil pump for a vehicle according to claim 5, wherein the turbulence generating portion is a groove that extends in a width direction of the driven gear.

8. The internal gear oil pump for a vehicle according to claim 5, wherein the turbulence generating portion is a plurality of protrusions that are arranged at predetermined intervals in a width direction of the driven gear.

9. The internal gear oil pump for a vehicle according to claim 5, wherein the turbulence generating portion is a plurality of holes that are arranged at predetermined intervals in a width direction of the driven gear.

10. The internal gear oil pump for a vehicle according to claim 6, wherein a shape of a cross section that is orthogonal to the width direction of the driven gear, of the protrusion is semicircular, rectangular, triangular, or multi-angular.

11. The internal gear oil pump for a vehicle according to claim 7, wherein a shape of a cross section that is orthogonal to the width direction of the driven gear, of the groove is semicircular, rectangular, triangular, or multi-angular.

12. The internal gear oil pump for a vehicle according to claim 1, wherein:

the rising surface is formed such that a thickness in a radial direction of the driven gear strictly increases from a minimum diameter position that is in front of a maximum diameter position with respect to the rotational direction of the driven gear, to the maximum diameter position; and the falling surface is formed such that a thickness in a radial direction of the driven gear strictly decreases from the maximum diameter position to the minimum diameter position that is in back of the maximum diameter position with respect to the rotational direction of the driven gear.

* * * * *